US008059848B2

(12) United States Patent
Akino

(10) Patent No.: US 8,059,848 B2
(45) Date of Patent: Nov. 15, 2011

(54) CONDENSER MICROPHONE UNIT

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 1008 days.

(21) Appl. No.: 12/000,121

(22) Filed: Dec. 10, 2007

(65) Prior Publication Data

US 2008/0144875 A1 Jun. 19, 2008

(30) Foreign Application Priority Data

Dec. 15, 2006 (JP) ..... 2006-338034

(51) Int. Cl.
*H04R 21/02* (2006.01)

(52) U.S. Cl. ..... 381/355

(58) Field of Classification Search ..... 381/122, 381/355–368

See application file for complete search history.

(56) References Cited

U.S. PATENT DOCUMENTS

2006/0045302 A1* 3/2006 Akino et al. ..... 381/355

* cited by examiner

*Primary Examiner* — Ha Tran T Nguyen
*Assistant Examiner* — Kevin Quinto
(74) *Attorney, Agent, or Firm* — Manabu Kanesaka

(57) ABSTRACT

In a condenser microphone unit in which a microphone capsule and a capsule support are connected to each other via a screwed ring coupler, shield is maintained stably regardless of the degree of tightening of the ring coupler. On one end side on which a microphone cord 30 is drawn into the capsule support 20, a shield covering wire exposure part 33*a* is formed. Also, a shield cup 40 including a small-diameter cylindrical part 41 and a large-diameter cylindrical part 42 is arranged in the capsule support 20, the small-diameter cylindrical part 41 is fixed to the shield covering wire exposure part 33*a* by staking, a flange part 421 having a diameter almost equal to the outside diameter of a circuit board 21 is formed on the surface on which the large-diameter cylindrical part 42 is in contact with the circuit board 21, and a staking allowance 274 that goes around to the lower surface side of the flange part 421 is connectingly provided on the lower edge side of the ring coupler 270, by which the circuit board 21 and the flange part 421 are integrated with each other by staking the staking allowance 274.

5 Claims, 3 Drawing Sheets

CONDENSER MICROPHONE UNIT

TECHNICAL FIELD

The present invention relates to a condenser microphone unit that includes an acoustoelectric converter in which a diaphragm and a backplate are arranged opposedly and an impedance converter, and is used by being connected to a power module section including a low cut circuit and a sound output circuit via a dedicated microphone cord. More particularly, it relates to a technique for preventing the generation of noise caused by electromagnetic waves applied to the microphone cord.

BACKGROUND ART

A condenser microphone is mounted with an impedance converter because the impedance of an acoustoelectric converter formed by a diaphragm and a backplate in a unit is high. In most cases, a field effect transistor (FET) is used as the impedance converter, but a vacuum tube is used on rare occasions.

Also, to fulfill the performance and function as a microphone, a sound output circuit, a power supply circuit, a low cut circuit, and the like are provided in the microphone. For a microphone for conference, a microphone for choir, a tie clip microphone attached to the chest part, and the like, the microphone must be inconspicuous.

For this reason, the condenser microphone is separated, in terms of configuration, into a microphone unit, which includes the acoustoelectric converter formed by the diaphragm and the backplate and the impedance converter, and a power module section (output module section) including the sound output circuit, the power supply circuit, the low cut circuit, and the like, and the microphone unit and the power module section are connected to each other by a dedicated microphone cord.

In this case, as the dedicated microphone cord, a two-core shield covered wire is used. This two-core shield covered wire includes a power wire for supplying power from the power module section to the microphone unit, a signal wire for giving sound signals, which are generated from the impedance converter in the condenser microphone unit, to the power module section, and a shielding wire that electrostatically shields the power wire and the signal wire and connects them to the ground.

This dedicated microphone cord is vulnerable to noise (disturbance) coming from the outside because the sound signals are transmitted unbalancedly. Therefore, if strong electromagnetic waves are applied to the dedicated microphone cord, the electromagnetic waves intrude into the microphone unit, being detected by the impedance converter, and therefore noise is sometimes generated.

In recent years, cellular phones have come into wide use rapidly. In the case where a cellular phone is used near a microphone, the microphone receives considerably strong electromagnetic waves (for example, within the range of about several centimeters to several tens centimeters, a field intensity reaching tens of thousands times of field intensity produced in the city by commercial electric waves). Therefore, in the field of microphone, measures against cellular phones are urgently needed.

Conventionally, when the microphone cord is drawn into the microphone unit and is connected to a circuit board on which the impedance converter is mounted, a knot for preventing coming-off is formed in the microphone unit. However, the length of wiring in the microphone unit increases accordingly, so that the electromagnetic waves easily intrude into the microphone unit through the microphone cord.

The applicant of the invention has proposed a condenser microphone unit that takes measures to solve the above problems as Patent Document 1 (Japanese Patent Application Publication No. 2006-74107). The configuration of the proposed condenser microphone unit is explained by reference to FIG. 4.

This condenser microphone unit includes a microphone capsule 10 and a capsule support 20 as a basic configuration, and is connected to a power module section, not shown, via a dedicated microphone cord 30.

The microphone capsule 10 includes a cylindrical capsule case 11 formed of, for example, a brass material. In the housing (cupsule case) 11, a diaphragm 12 stretchedly provided on a support ring 13 and a backplate 14 supported on an insulating seat 15 are housed in the state of being arranged opposedly via an electrical insulating spacer (not shown).

The back surface side of the housing 11 is closed by a back lid 16, and a contact pin 17 that is connected to the backplate 14 via a wiring, not shown, protrudes from the back lid 16. Also, on the rear end side of the capsule case 11, an internally threaded cylinder 18 for connecting with the capsule support 20 is fixed so as to be electrically conducting with the capsule case 11.

The capsule support 20 includes a cylindrical housing 201 formed of, for example, a brass material, and the microphone capsule 10 is detachably connected to the capsule support 20 via a ring coupler 27 formed with external threads at the outer periphery thereof.

On one end side (the upper end side in FIG. 4) of the housing 201, internal threads 202 are formed. The lower half of the external threads of the ring coupler 27 is threadedly engaged with the internal threads 202, and the internally threaded cylinder 18 is threadedly engaged with the upper half of the external threads of the ring coupler 27 in this state, by which the microphone capsule 10 and the capsule support 20 are connected to each other.

Also, the housing 201 is formed with a concave step part 203 at a lower position of the internal threads 202, and as a receiver of the concave step part 203, a circuit board 21 is arranged on one end side of the housing 201 so as to close the interior of the housing 201.

In the example shown in FIG. 4, an FET 22 is mounted on the lower surface side of the circuit board 21 as an impedance converter. The circuit board 21 is a double-sided circuit board. FIG. 5A shows the wiring pattern on the upper surface of the circuit board 21, and FIG. 5B shows the wiring pattern on the lower surface on which the FET 22 is mounted.

The wiring pattern on the lower surface on which the FET 22 is mounted includes lead wirings for electrodes of gate, drain, and source of the FET 22, and the lead wiring for gate of these lead wirings is connected to a gate electrode terminal 211, which is formed in the center on the upper surface side of the circuit board 21, via a wiring in a through hole.

On the upper surface side and the lower surface side in the outer peripheral edge part of the circuit board 21, ground patterns 212*a* and 212*b* connected to the drain or source of the FET 22 are formed, respectively, so as to be conducting with each other via a wiring in a through hole.

On the upper surface of the circuit board 21 shown in FIG. 5A, a contact terminal 23 consisting of a plate spring that is in contact with the contact pin 17 is mounted in a state of being held on a spacer 24 of a rubber elastic body. The lower end of the contact terminal 23 is in contact with the gate electrode terminal 211 connecting with the lead wiring for gate of the FET 22.

Thereby, when the microphone capsule 10 is connected to the capsule support 20 via the ring coupler 27, the backplate 14 is connected to the gate of the FET 22 via the contact pin 17, the contact terminal 23, and the gate electrode terminal 211.

Also, the outer peripheral edge part of the circuit board 21 is held between the lower end part of the ring coupler 27 and the concave step part 203 of the housing 201. Thereby, the ground pattern 212*a* formed on the upper surface side in the outer peripheral edge part of the circuit board 21 is brought into tight contact with the ring coupler 27, and the ground pattern 212*b* formed on the lower surface side in the outer peripheral edge part of the circuit board 21 is brought into tight contact with the housing 201.

On the other end side (the lower end side in FIG. 4) of the capsule support 20, a cord introduction hole 25 having a cord bush 26 is provided. Through this cord introduction hole 25, the dedicated microphone cord 30 extending from the side of the power module section, not shown, is drawn into the capsule support 20.

As the microphone cord 30, a two-core shield covered wire is used which includes a power wire 31 for supplying power to the microphone capsule 10, a signal wire 32 for sending sound signals generated from the FET 22 to the power module section, not shown, and a net-shaped shield covering wire 33 that electrostatically shields the power wire and the signal wire and connects them to the ground.

According to the invention described in Patent Document 1, the microphone cord 30 is provided with a shield covering wire exposure part 33*a*, in which the shield covering wire 33 is stripped out, in a portion in which the microphone cord 30 is drawn into the capsule support 20, and a fastening fixture 40 is fixed in the shield covering wire exposure part 33*a*.

The shield covering wire exposure part 33*a* can be formed, for example, by removing the skin on the tip end side of the microphone cord 30 connected to the circuit board 21 to strip out the shield covering wire 33 and by folding back the stripped-out shield covering wire 33.

The fastening fixture 40 is formed as an annularly-shaped body of a washer shape (doughnut shape) that is thick and has a diameter larger than that of the cord introduction hole 25. The outside diameter thereof has a size such that the outside diameter is in close contact with the inner surface of the capsule support 20. Also, on the inner periphery side through which the microphone cord 30 is inserted, a staking sleeve 41 that is fixed to the shield covering wire exposure part 33*a* by plastic deformation is formed integrally.

When the microphone cord 30 is attached to the capsule support 20, after the microphone cord 30 has been inserted through the cord introduction hole and the tip end side thereof has been drawn out to the outside of the capsule support 20, the fastening fixture 40 is fitted on the shield covering wire exposure part 33*a* of the microphone cord 30, and the sleeve 41 is staked to fix the microphone cord 30.

After the power wire 31 and the signal wire 32 of the microphone cord have been soldered to a predetermined lead wiring on the circuit board 21, the tip end side of the microphone cord 30 is drawn into the capsule support 20 to engage the circuit board 21 with the concave step part 203 of the housing 201, and also the outer periphery side of the fastening fixture 40 is brought into contact with the inner surface of the capsule support 20.

Thereby, the microphone cord 30 is prevented from coming off, and also the shield covering wire 33 is electrically connected surely to the capsule support 20 via the fastening fixture 40, so that a high-frequency current caused by strong electromagnetic waves applied to the microphone core 30 flows to the capsule support 20 side, and does not intrude into the capsule support 20. Therefore, the generation of noise caused by electromagnetic waves is prevented.

As described above, according to the invention described in Patent Document 1, a knot for preventing coming-off of microphone cord need not be formed in the capsule support 20, and also the shield covering wire 33 is electrically connected surely to the capsule support 20. However, since the microphone capsule 10 and the capsule support 20 are connected to each other via a ring coupler 27, a problem as described below may occur.

When the ring coupler 27 is loosened by vibrations or shocks applied from the outside, or when the microphone capsule 10 is screwed firmly onto the ring coupler 27 with an excessive force, the stress between the ring coupler 27 and the capsule support 20 decreases.

As a result, the ring coupler 27 and the capsule support 20 become in bad contact with the ground patterns 212*a* and 212*b* of the circuit board 21, and therefore the shield between the microphone capsule 10 and the capsule support 20 becomes incomplete. Therefore, noise is generated by the high-frequency current, and in an extreme case, a trouble such that the sound signal is broken off occurs.

Accordingly, an object of the present invention is to provide a condenser microphone unit configured by connecting a microphone capsule to a capsule support via a screwed ring coupler, in which shield is maintained stably regardless of the degree of tightening of the ring coupler.

SUMMARY OF THE INVENTION

To achieve the above object, the present invention has a feature as described below. In a condenser microphone unit including a microphone capsule having first internal threads for connection on the rear end side of a capsule case, in which a diaphragm and a backplate are arranged opposedly in the capsule case; a capsule support having second internal threads for connection on the upper end side and a cord introduction hole on the lower end side; and a ring coupler having external threads almost upper half of which is threadedly engaged with the first internal threads and almost lower half of which is threadedly engaged with the second internal threads, which connects the microphone capsule and the capsule support to each other, in which a circuit board having an impedance converter is housed in a cylindrical housing part of the capsule support, and one end side of a microphone cord consisting of a two-core shield covered wire is drawn through the cord introduction hole and is connected to the circuit board, the microphone cord includes a shield covering wire exposure part, in which a shield covering wire is stripped out, on one end side on which the microphone cord is drawn into the capsule support; and a shield cup, which includes a small-diameter cylindrical part through which the shield covering wire exposure part is inserted and which is fixed to the shield covering wire exposure part by staking, and a large-diameter cylindrical part which has an outside diameter increased from the upper end of the small-diameter cylindrical part so as to be smaller than the outside diameter of the circuit board and extends to a position at which the large-diameter cylindrical part is in contact with the lower surface of the circuit board, is provided in the capsule support, and a flange part having an outside diameter increased so as to be almost equal to the outside diameter of the circuit board is formed on the surface on which the large-diameter cylindrical part is in contact with the circuit board; a board pressing step part for pressing the upper surface side of an outer peripheral edge part of the circuit board is formed at the inner periphery on the upper edge side of the ring coupler; and a staking allowance which goes around to the lower surface side of the flange part to integrate the circuit board and the flange part with each other between the staking allowance and the board pressing step part is connectingly provided on the lower edge side of the ring coupler.

In the present invention, the staking allowance may be formed into a cylindrical shape and have a thickness smaller than that of the ring coupler, or may be formed into a tongue shape, having a thickness smaller than that of the ring coupler, and a plurality of staking allowances may be arranged at equal intervals.

Also, a ground layer of the circuit board is preferably formed in the outer peripheral edge part of the circuit board, which is in contact with the flange part.

Further, a mode in which a plate spring which is in contact with a draw-out electrode of the microphone capsule is arranged on the upper surface side of the circuit board in a state of being held in a central opening part of an umbrella-shaped cap member, and a foot part of the cap member is held between the board pressing step part and the outer peripheral edge part of the circuit board is also embraced in the present invention.

According to the present invention, in the condenser microphone unit in which the microphone capsule and the capsule support are connected to each other via the ring coupler having external threads almost upper half of which is threadedly engaged with the first internal threads and almost lower half of which is threadedly engaged with the second internal threads; the circuit board having an impedance converter is housed in the cylindrical housing part of the capsule support; and one end side of the microphone cord consisting of a two-core shield covered wire is drawn through the cord introduction hole and is connected to the circuit board, the shield covering wire exposure part, in which the shield covering wire is stripped out, is formed on one end side on which the microphone cord is drawn into the capsule support; the shield cup including the small-diameter cylindrical part and the large-diameter cylindrical part is arranged in the capsule support; the small-diameter cylindrical part is fixed to the shield covering wire exposure part by staking; the flange part having a diameter almost equal to the outside diameter of a circuit board is formed on the surface on which the large-diameter cylindrical part is in contact with the circuit board; the staking allowance that goes around to the lower surface side of the flange part is connectingly provided on the lower edge side of the ring coupler; and thereby the circuit board and the flange part are integrated with each other between the staking allowance and the board pressing step part formed on the upper edge side of the ring coupler by staking the staking allowance, by which shield can be maintained stably regardless of the degree of tightening of the ring coupler.

DETAILED DESCRIPTION

Figure 1:
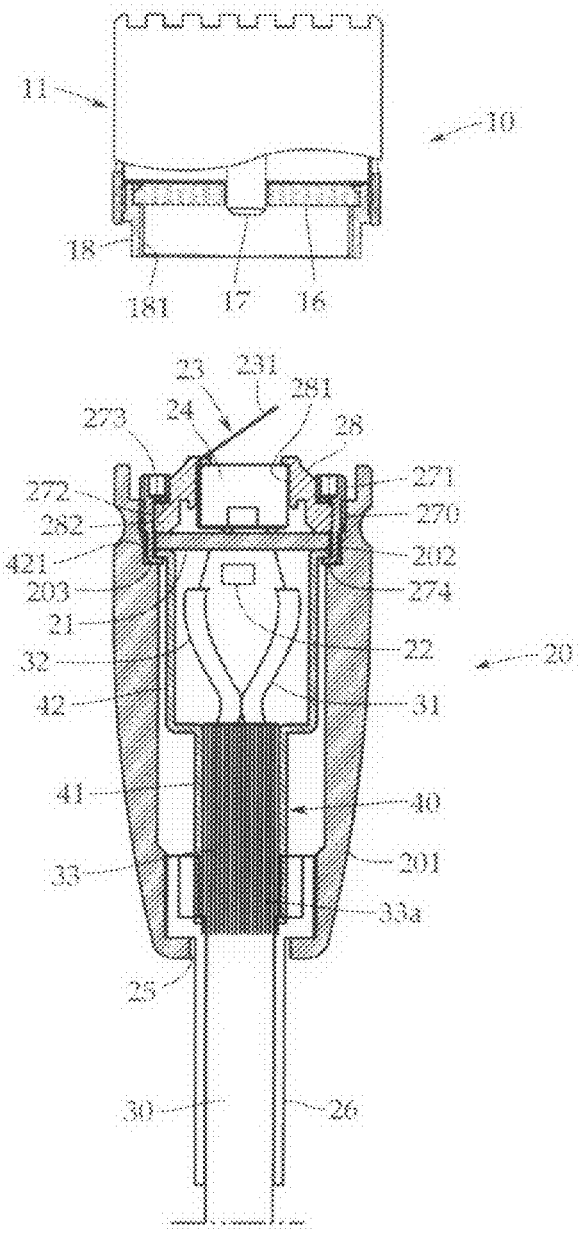
FIG. 1 is a sectional view separately showing a microphone capsule and a capsule support included in a condenser microphone unit in accordance with the present invention.
Figure 2:
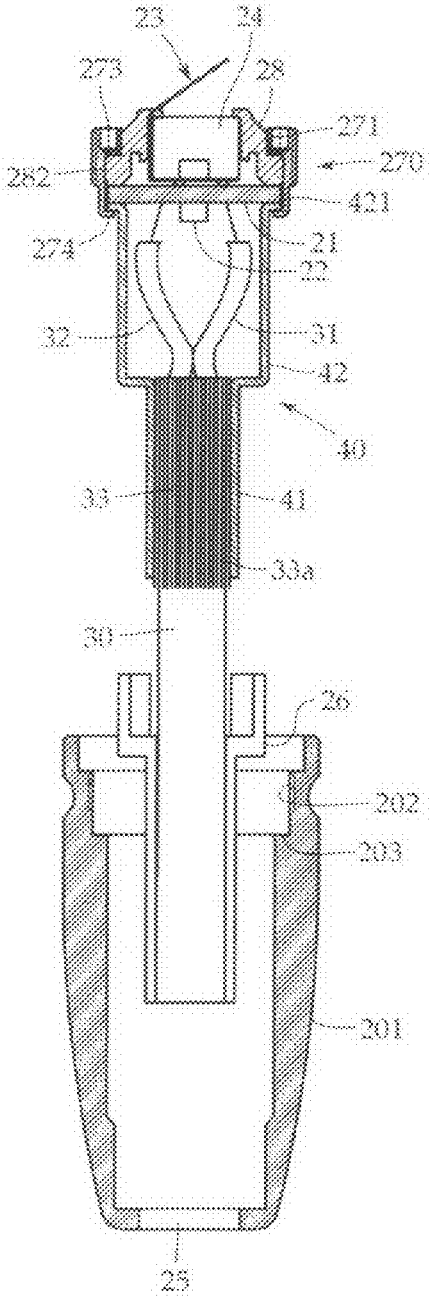
FIG. 2 is an exploded sectional view showing a state in which a shield cup part is drawn out of a housing of the capsule support shown in FIG. 1.
Figure 3:
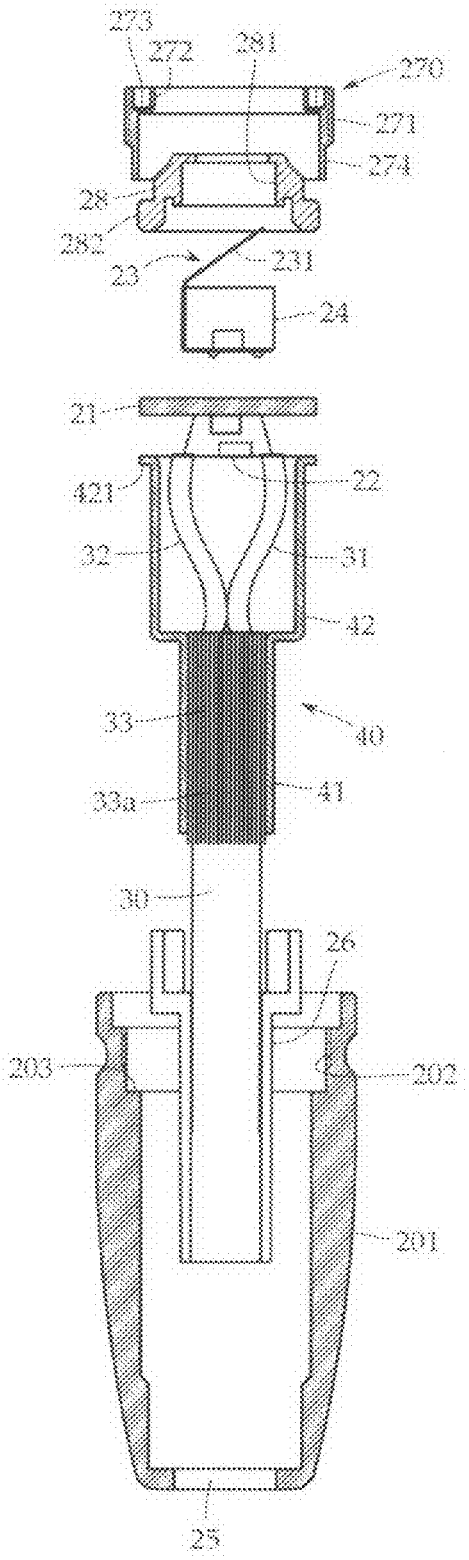
FIG. 3 is a detailed exploded view of the capsule support shown in FIG. 1.
Figure 4:
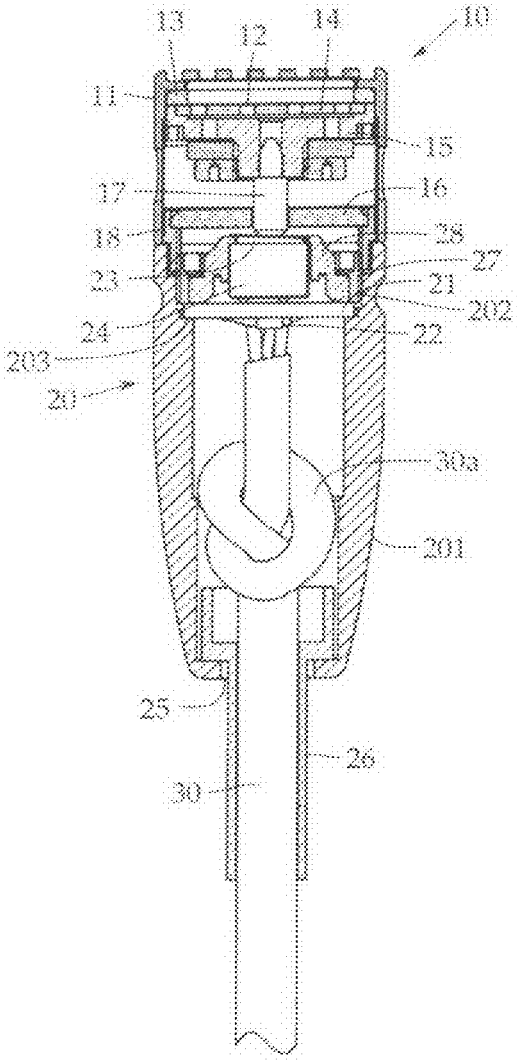
FIG. 4 PRIOR ART
FIG. 4 is a sectional view of a conventional condenser microphone unit.

An embodiment of the present invention will now be described by reference to FIGS. 1 to 3. FIG. 1 is a sectional view separately showing a microphone capsule and a capsule support included in a condenser microphone unit in accordance with the present invention. FIG. 2 is an exploded sectional view showing a state in which a shield cup part is drawn out of a housing of the capsule support. FIG. 3 is a detailed exploded view of the capsule support. In these figures, the same reference numerals are applied to elements that are the same as those of a conventional example shown in FIGS. 4 and 5.

Referring to FIGS. 1 to 3, in this condenser microphone unit, the microphone capsule 10 may have the same configuration as that of the conventional example, so that the explanation thereof is omitted, and for convenience of drawing, only a connecting part (an internally threaded cylinder 18 having internal threads (first internal threads) 181 and a contact pin 17) for the capsule support 20 is shown, and the illustration of other elements of the microphone capsule 10 is omitted.

In this embodiment as well, the capsule support 20 includes a cylindrical housing 201 formed of a metallic material such as brass or aluminum. The capsule support 20 is connected to a power module section (output module section), not shown, via a dedicated microphone cord 30 consisting of a two-core shield covered wire. However, the capsule support 20 may be supported at the tip end of a flexible pipe as, for example, a gooseneck microphone.

In the housing 201 of the capsule support 20, a cylindrical housing space is formed. In this housing space, a circuit board 21 is housed, and also a ring coupler 270 for connecting the microphone capsule 10 is screwed in.

Therefore, on one end side (the upper end side in FIGS. 1 to 3) of the housing 201, a concave step part 203 for receiving the peripheral edge part of the circuit board 21 and internal threads (second internal threads) 202 for threadedly engaging the ring coupler 270 are formed. In this case, the concave step part 203 is arranged under the internal threads 202.

In this embodiment as well, an FET 22 serving as an impedance converter is mounted on the back surface side (anti-microphone capsule side) of the circuit board 21. Although not shown in FIGS. 1 to 3, in a substantially central part on the upper surface side of the circuit board 21, a gate electrode terminal 211 connected to the gate terminal of the FET 22 via a wiring in a through hole is formed as a circular pattern as shown in FIG. 5.

Figure 5A:
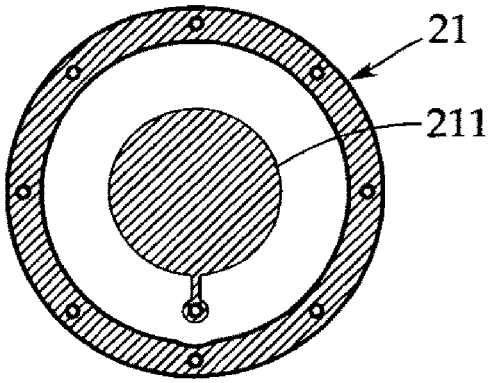
FIG. 5A PRIOR ART
FIG. 5A is a top view of a circuit board housed in the conventional condenser microphone unit shown in FIG. 4.
Figure 5B:
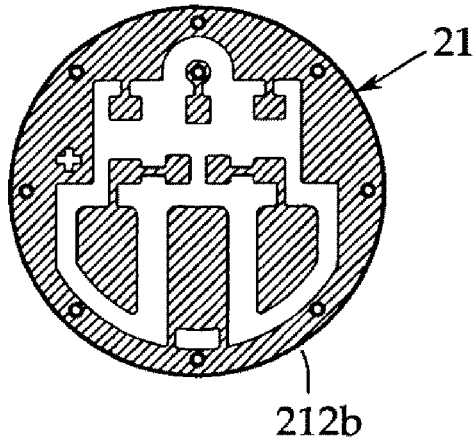
FIG. 5B PRIOR ART
FIG. 5B is a bottom view of a circuit board housed in the conventional condenser microphone unit shown in FIG. 4.

Also, although not shown in FIGS. 1 to 3, on both upper and lower surfaces of the outer peripheral edge part of the circuit board 21, ground patterns 212*a* and 212*b* connected to a ground terminal (source or drain) other than the gate terminal of the FET 22 are formed along the outer peripheral edge part of the circuit board 21 as shown in FIG. 5. The ground pattern 212*a* on the upper surface side and the ground pattern 212*b* on the lower surface side are conducting via a wiring in a through hole.

On the gate electrode terminal 211 formed on the upper surface side of the circuit board 21, a contact terminal 23 consisting of a plate spring material that is in contact with the contact pin 17 on the microphone capsule 10 side is placed in a state of holding a block body 24. The block body 24 may be formed of a synthetic resin having a proper elasticity, such as silicone resin.

To position the contact terminal 23 on the gate electrode terminal 211 together with the block body 24, an electrical insulating cap member 28 is used. The cap member 28 has an opening part 281 for holding the contact terminal 23 in the state in which a contact piece 231 of the contact terminal 23 projects slantwise upward, and a substantially umbrella-shaped foot part 282 ranging from the opening part 281 to the outer peripheral edge part of the circuit board 21.

The cap member 28 may be formed of a hard resin or a soft resin, and preferably a natural or synthetic rubber elastic body is used as the cap member 28. Also, when the microphone capsule 10 is turned with respect to the capsule support 20 for the purpose of exchange, a rotation preventive means with respect to the contact terminal 23 is preferably provided in the opening part 281 of the cap member 28 to prevent the rotation and torsion of the contact terminal caused by the turning.

The ring coupler 270 includes the internal threads 202 formed in the housing 201 on the outer peripheral surface thereof, and external threads 271 that threadedly engage with the internal threads 181 on the microphone capsule 10 side. On the inner surface on the upper end side of the ring coupler 270, a board pressing step part 272 is formed.

In this example, the board pressing step part 272 presses the upper surface side of the outer peripheral edge part of the circuit board 21 via the foot part 282 of the cap member 28. On the upper surface of the board pressing step part 272, a plurality of locking holes 273 for hooking a rotating tool, not shown, used for turning the ring coupler 270 are provided at several locations.

By threadedly engaging the internal threads 181 on the microphone capsule 10 side with the upper half of the external threads 271 in the state in which the lower half of the external threads 271 of the ring coupler 270 is threadedly engaged with the internal threads 202 of the capsule support 20, the microphone capsule 10 is attached to the capsule support 20.

On the other end side (the lower end side in FIGS. 1 to 3) of the capsule support 20, a cord introduction hole 25 having a cord bush 26 is provided, and a dedicated microphone cord 30 extending from the cord introduction hole 25 to the side of the power module section, not shown, is drawn into the capsule support 20.

As the microphone cord 30, a two-core shield covered wire is used which includes a power wire 31 for supplying power to the microphone capsule 10, a signal wire 32 for sending sound signals generated from the FET 22 to the power module section, not shown, and a net-shaped shield covering wire 33 that electrostatically shields the power wire and the signal wire and connects them to the ground.

The microphone cord 30 is provided with a shield covering wire exposure part 33*a*, in which the shield covering wire 33 is stripped out, in a portion in which the microphone cord 30 is drawn into the capsule support 20. The shield covering wire exposure part 33*a* may be formed, for example, by removing the skin on the tip end side of the microphone cord 30 connected to the circuit board 21 to strip out the shield covering wire 33 and by folding back the stripped-out shield covering wire 33.

In the present invention, to stably maintain the shield of the whole of the microphone unit including the microphone capsule 10 and the capsule support 20, a shield cup 40 housed in the capsule support 20 is provided.

The shield cup 40 includes a small-diameter cylindrical part 41 and a large-diameter cylindrical part 42, and the whole of the shield cup 40 is formed of a metallic material such as aluminum. In the small-diameter cylindrical part 41, the shield covering wire exposure part 33*a* is inserted, and the small-diameter cylindrical part 41 is fixed to the shield covering wire exposure part 33*a* by staking.

The large-diameter cylindrical part 42 has a diameter increased from one end side (the upper end side in FIGS. 1 to 3) of the small-diameter cylindrical part 41, and has a length reaching the bottom surface (in this example, the surface on which the FET 22 is mounted) of the circuit board 21. The outside diameter of the large-diameter cylindrical part 42 is larger than that of the small-diameter cylindrical part 41, but is smaller than the outside diameter of the circuit board 21 and the inside diameter of the housing space of the capsule support 20.

In the large-diameter cylindrical part 42, the power wire 31 and the signal wire 32 of the microphone cord 30 are laid, and the power wire 31 and the signal wire 32 are soldered to a predetermined lead wiring of the circuit board 21.

On the surface on which the large-diameter cylindrical part 42 is in contact with the circuit board 21, a flange part 421 having an outside diameter increased so as to be almost equal to the outside diameter of the circuit board 21 is formed.

In the present invention, to bring the flange part 421 of the large-diameter cylindrical part 42 into tight contact with a ground pattern 212*b* (refer to FIG. 5B) formed in the outer peripheral edge part of the circuit board 21 so that looseness does not develop, as shown in FIG. 3, a staking allowance 274 capable of going around to the lower surface side of the flange part 421 is connectingly provided on the lower edge side of the ring coupler 270.

After the circuit board 21 has been arranged coaxially on the flange part 421 of the large-diameter cylindrical part 42, and the contact terminal 23 has been placed on the circuit board 21 while being held by the cap member 28, the ring coupler 270 is put from above, and the staking allowance 274 is staked to the inside in the radial direction as shown in FIG. 2, by which the circuit board 21 and the flange part 421 of the large-diameter cylindrical part 42 can be integrated between the staking allowance 274 and the board pressing step part 272.

According to this configuration, even if the ring coupler 270 is loosened by vibrations or shocks applied from the outside, or the microphone capsule 10 is screwed firmly onto the ring coupler 270 with an excessive force, whereby the stress between the ring coupler 270 and the capsule support 20 is decreased, the contact between the circuit board 21 and the flange part 421 of the large-diameter cylindrical part 42 is kept properly by staking of the staking allowance 274. Furthermore, since a shield path leading from the microphone capsule 10 to the shield covering wire 33 via the ring coupler 270 and the shield cup 40 is secured, a stable shield effect can be achieved.

In the above-described embodiment, the staking allowance 274 is formed into a cylindrical shape and has a thickness smaller than that of the ring coupler 270. However, the staking allowance may be formed into a tongue shape, having a thickness smaller than that of the ring coupler 270, and may be arranged at several locations.

The present application is based on, and claims priority from, Japanese Application Serial Number JP2006-338034, filed Dec. 15, 2006, the disclosure of which is hereby incorporated by reference herein in its entirety.

The invention claimed is:

1. A condenser microphone unit comprising:

a microphone capsule having first internal threads for connection on the rear end side of a capsule case, in which a diaphragm and a backplate are arranged opposedly in the capsule case;

a capsule support having second internal threads for connection on the upper end side and a cord introduction hole on the lower end side; and a ring coupler having external threads almost upper half of which is threadedly engaged with the first internal threads and almost lower half of which is threadedly engaged with the second internal threads, which connects the microphone capsule and the capsule support to each other, in which a circuit board having an impedance converter is housed in a cylindrical housing part of the capsule support, and one end side of a microphone cord consisting of a two-core shield covered wire is drawn through the cord introduction hole and is connected to the circuit board, wherein the microphone cord includes a shield covering wire exposure part, in which a shield covering wire is stripped out, on one end side on which the microphone cord is drawn into the capsule support; and a shield cup, which includes a small-diameter cylindrical part through which the shield covering wire exposure part is inserted and which is fixed to the shield covering wire exposure part by staking, and a large-diameter cylindrical part which has an outside diameter increased from the upper end of the small-diameter cylindrical part so as to be smaller than the outside diameter of the circuit board and extends to a position at which the large-diameter cylindrical part is in contact with the lower surface of the circuit board, is provided in the capsule support, and a flange part having an outside diameter increased so as to be almost equal to the outside diameter of the circuit board is formed on the surface on which the large-diameter cylindrical part is in contact with the circuit board; a board pressing step part for pressing the upper surface side of an outer peripheral edge part of the circuit board is formed at the inner periphery on the upper edge side of the ring coupler; and a staking allowance which goes around to the lower surface side of the flange part to integrate the circuit board and the flange part with each other between the staking allowance and the board pressing step part is connectingly provided on the lower edge side of the ring coupler.

2. The condenser microphone unit according to claim 1, wherein the staking allowance is formed into a cylindrical shape and has a thickness smaller than that of the ring coupler.

3. The condenser microphone unit according to claim 1, wherein the staking allowance is formed into a tongue shape, having a thickness smaller than that of the ring coupler, and a plurality of staking allowances are arranged at equal intervals.

4. The condenser microphone unit according to claim 1, wherein a ground layer of the circuit board is formed in an outer peripheral edge part of the circuit board, which is in contact with the flange part.

5. The condenser microphone unit according to claim 1, wherein a plate spring which is in contact with a draw-out electrode of the microphone capsule is arranged on the upper surface side of the circuit board in a state of being held in a central opening part of an umbrella-shaped cap member, and a foot part of the cap member is held between the board pressing step part and the outer peripheral edge part of the circuit board.

* * * * *